US006491053B1

(12) United States Patent
Briggeman et al.

(10) Patent No.: US 6,491,053 B1
(45) Date of Patent: Dec. 10, 2002

(54) METHOD AND SYSTEM FOR REDUCING THE VISCOSITY OF CRUDE OIL

(76) Inventors: William H. Briggeman, 3701 S. 71st West Ave., Tulsa, OK (US) 74107; John J. Black, P.O. Box 1157, Mannford, OK (US) 74044

( * ) Notice: Subject to any disclaimer, the term of this patent is extended or adjusted under 35 U.S.C. 154(b) by 0 days.

(21) Appl. No.: 09/567,556

(22) Filed: May 5, 2000

Related U.S. Application Data

(60) Provisional application No. 60/135,529, filed on May 24, 1999.

(51) Int. Cl.[7] ..... F17D 1/16; F17D 1/17

(52) U.S. Cl. ..... 137/13; 138/42; 138/113; 138/114

(58) Field of Search ..... 137/13, 896, 4, 137/92; 138/113, 114, 42; 44/301, 302; 585/899

(56) References Cited

U.S. PATENT DOCUMENTS

| | | | | | |
|---|---|---|---|---|---|
| 3,006,354 | A | * | 10/1961 | Sommer et al. | 137/13 |
| 3,040,760 | A | * | 6/1962 | Macks | 137/13 |
| 3,389,714 | A | * | 6/1968 | Hughes et al. | 137/13 |
| 3,425,429 | A | * | 2/1969 | Kane | 137/13 |
| 3,618,624 | A | * | 11/1971 | Valrogs | 137/13 |
| 3,653,438 | A | | 4/1972 | Wagner | 166/266 |
| 3,726,298 | A | * | 4/1973 | Meritt | 137/13 |
| 4,287,902 | A | * | 9/1981 | McClaflin et al. | 137/13 |
| 4,333,488 | A | * | 6/1982 | McClaflin | 137/13 |
| 4,340,076 | A | * | 7/1982 | Weitzen | 137/13 |
| 4,420,008 | A | * | 12/1983 | Shu | 137/13 |
| 5,000,872 | A | * | 3/1991 | Olah | 137/13 |
| 5,025,863 | A | | 6/1991 | Haines et al. | 166/305.1 |
| 5,104,516 | A | | 4/1992 | de Bruijn et al. | 208/107 |
| 5,283,001 | A | | 2/1994 | Gregoli et al. | 252/314 |
| 5,322,617 | A | | 6/1994 | de Bruijn et al. | 208/108 |
| 5,566,760 | A | | 10/1996 | Harris | 166/308 |
| 5,863,301 | A | | 1/1999 | Grosso et al. | 44/301 |
| 6,054,496 | A | * | 4/2000 | Crane et al. | 137/13 |
| 6,201,163 | B1 | * | 3/2001 | Morris et al. | 137/13 |

FOREIGN PATENT DOCUMENTS

| | | | | |
|---|---|---|---|---|
| FR | 2484603 | * | 12/1981 | 137/13 |
| GB | 1235150 | * | 6/1971 | 137/13 |
| SU | 508641 | * | 6/1976 | 137/13 |
| SU | 752117 | * | 7/1980 | 137/13 |

* cited by examiner

*Primary Examiner*—George L. Walton
(74) *Attorney, Agent, or Firm*—Gable & Gotwals; Paul H. Johnson

(57) ABSTRACT

A method of decreasing the viscosity of crude oil including the steps of injecting into the crude oil $CO_2$ alone or $CO_2$ mixed with N at an elevated pressure of about 600 psi to about 1800 psi and intemently mixing the $CO_2$, or $CO_2$ mixed with N, with the crude oil at the elevated pressure.

7 Claims, 1 Drawing Sheet

METHOD AND SYSTEM FOR REDUCING THE VISCOSITY OF CRUDE OIL

REFERENCE TO PENDING APPLICATIONS

This is a conversion application related to United States Provisional Patent Application Serial No. 60/135,529 filed on May 24 ,1999 for A METHOD AND SYSTEM FOR REDUCING THE VISCOSITY OF CRUDE OIL.

REFERENCE TO MICROFICHE APPENDIX

This application is not referenced in any Microfiche Appendix.

1. Field of the Invention

The invention herein relates to a method and a system to reducing the viscosity of crude oil at the earth's surface to improve the flowability and pumpability and to thereby augment the movement of crude oil through pipelines and process equipment. The invention herein is intended to achieve the ultimate goal of reducing the problems and expense of moving heavier or more viscous crude oil through pipeline and process equipment.

2. Background of the Invention

Others have taught the concept of mixing gases with liquids to change the characteristic of the liquids, including the viscosity thereof. More particularly, others have suggested the use of gases mixed with crude oil, particularly in subterranean locations, to augment production of crude oil. As an example, U.S. Pat. No. 5,025,863 entitled, "Enhanced Liquid Hydrocarbon Recovery Process" teaches the use of natural gas injected into an oil bearing formation to render the liquid hydrocarbons mobile and thereafter the mobilized liquid hydrocarbons are more easily produced from the well.

In U.S. Pat. No. 5,104,516 entitled, "Upgrading Oil Emulsions With Carbon Monoxide or Synthetic Gas" involves contacting a water emulsion of a heavy oil with carbon monoxide at a temperature range such that a water gas shift reaction takes place to thereby assist in reducing the viscosity of the crude oil.

For other background information relating to the general subject matter of the invention herein reference may be had to the following United States patents:

| PATENT NO. | INVENTOR | TITLE |
|---|---|---|
| 3,653,438 | Wagner | Method for Recovery of Petroleum Deposits |
| 5,025,863 | Haines et al. | Enhanced Liquid Hydrocarbon Recovery Process |
| 5,104,516 | de Bruijn et al. | Upgrading Oil Emulsions with Carbon Monoxide or Synthesis Gas |
| 5,283,001 | Gregoti et al. | Process for Preparing a Water Continuous Emulsion from Heavy Crude Fraction |
| 5,322,617 | de Bruijn et al. | Upgrading Oil Emulsions with Carbon Monoxide or Synthesis Gas |
| 5,566,760 | Harris | Method of using a Foamed Fracturing Fluid |

-continued

| PATENT NO. | INVENTOR | TITLE |
|---|---|---|
| 5,863,301 | Grosso et al. | Method of Produce Low Viscosity Stable Crude Oil Emulsion |

BRIEF SUMMARY OF THE INVENTION

Crude oil, particularly that produced from certain geological formations, can be relatively viscid, that is, can have a viscosity that makes it difficult to transfer through a pipeline. Heavy, thick viscid crude oil is referred to in the petroleum industry as "low gravity" oil; high gravity crude oil being that which is relatively thin and relatively easy to pump.

The viscosity of crude oil is affected by temperature and one way to decrease the viscosity of crude oil is to increase the temperature. While increasing temperature is a common way to reduce viscosity it is an expensive procedure and is not an acceptable procedure for improving the viscosity of crude oil that must be transmitted over a relatively long distance pipeline since maintaining an elevated temperature of crude oil in a pipeline is extremely difficult.

Another way of decreasing the viscosity of crude oil is to mix with it an immiscible high gravity liquid component. For instance, gasoline, kerosene or other high gravity components can be mixed with viscid crude oil to reduce the viscosity so that it can be more effectively pumped. At the destination, the added gasoline, kerosene or so forth can be removed and recycled. This procedure works effectively to reduce the viscosity of crude oil but is expensive and in many applications impractical, particularly where crude oil must be pumped over a relatively long distance so that thereby recirculating the thinning agent becomes a serious problem.

Viscosity is the degree to which a fluid resists flow under an applied force. Viscosity is measured by the tangential stress on the fluid divided by the resultant viscosity gradient under conditions of streamlined flow. The unit of measurement of viscosity is "poise". Poise is a centimeter-gram-second unit of dynamic viscosity equal to one dyne-second per square centimeter. Viscosity is usually expressed in 1/100th of a poise, that is, in centipoise. In the petroleum industry the pumpability of crude oil is usually characterized by its gravity. High gravity crude oil is thin and easily pumpable. Low gravity crude oil is thick and difficult to pump. High gravity equates to low viscosity and high viscosity to low gravity.

The present invention is concerned with a method of decreasing the viscosity of crude oil in a manner that does not require elevating its temperature or the use of a high gravity liquid thinning component. The present invention achieves reduced viscosity of crude oil by injecting into the crude oil, under high pressure, a gas, or a combination of gases. Particularly the invention is concerned with injecting into crude oil carbon dioxide ($CO_2$) or more preferably, a combination of $CO_2$ and nitrogen (N).

In a system for practicing the invention, $CO_2$ is thoroughly admixed with crude oil at an elevated pressure. Instead of $CO_2$ only, a mixture of $CO_2$ and N may be employed in ratios ranging from 8% N, 92% $CO_2$ to 92% N, 8% $CO_2$. The $CO_2$, or mixture of $CO_2$ and N, is thoroughly admixed with crude oil at a pressure of at least about 600 lbs per square inch (psi). A preferred pressure for admixing crude oil and gas to achieve decreased viscosity is from about 600 psi to 1800 psi although the maximum upper pressure is limited only by the availability of equipment and the expense of attaining the higher pressure.

In practicing the invention the crude oil is introduced into a mixer that may be in the form of an elongated horizontal cylindrical treating vessel having within it a reduced diameter centralized gas injection pipe, the pipe having a plurality of spaced apart small diameter openings therein. A spiraled, auger-shaped fin is affixed to the gas injection pipe to cause the crude oil flowing through the treating vessel to take a circuitous route and to thereby cause a more thorough admixing of injected gas and crude oil.

The quantity of gas employed is determined by the viscosity reduction required. For maximum viscosity reduction the maximum gas the crude oil will absorb is used. Stated another way, the reduction in viscosity is most effectively and efficiently obtained by employing gas the rate at which, for the treating pressure level, all of the gas is absorbed by the crude oil.

Experience has indicated that crude oil, having been treated to cause the absorption of $CO_2$ or a combination of $CO_2$ and N, at elevated pressures, attains a reduced viscosity that is relatively long lasting. When the treated oil is exposed to ambient pressure the dissolved gas eventually separates out of solution and the crude oil will eventually revert to its natural viscosity, however, the rate of separation is not instantaneous when pressure reduction occurs but is a relatively slow process so that crude oil, after having the viscosity reduced by the methods of this invention can be pumped efficiently over relatively long distances.

DESCRIPTION OF THE DRAWINGS

FIG. 2 illustrates one means of improving the absorption of injected gases.

DETAILED DESCRIPTION OF A PREFERRED EMBODIMENT

This invention is a process for decreasing the viscosity of low gravity crude oil in a nondestructive manner to thereby decrease the horsepower required to transport the crude oil in a pipeline over a long distance.

The invention employs the use of a mixing chamber for mixing low gravity crude oil by the injection of a gas or gases under pressure to create a high gravity oil which will remain in this state as it is pumped through a pipeline. Tests have indicated that at treating pressures between 600 psi and 1800 psi, injecting a gas solution of $CO_2$ and N into low gravity crude oil and then flowing this mixture through a fluid velocity changing device that a miscible solution of high gravity crude oil is achieved and the characteristics of this improved gravity crude oil do not change markedly as pressure-drop points are encountered. The mixture of $CO_2$ and N can be varied with $CO_2$ ranging from 8% to 92% by volume and N ranging from 8% to 92% by volume. The reduction in gravity will vary in proportion to the quantity of $CO_2$ or $CO_2$ plus N injected into the crude oil.

The gas agent can be varied from a composition of 8% $CO_2$ and 92% N to 100% $CO_2$ and 0% N. The effect of viscosity reduction varies with the mixture of $CO_2$ and N and the composition of the oil being treated. The optimum ratio of $CO_2$ and N is dependent somewhat upon the cost and availability of these gases taken into consideration with the reduced cost of pumping high gravity oil.

Figure 1:
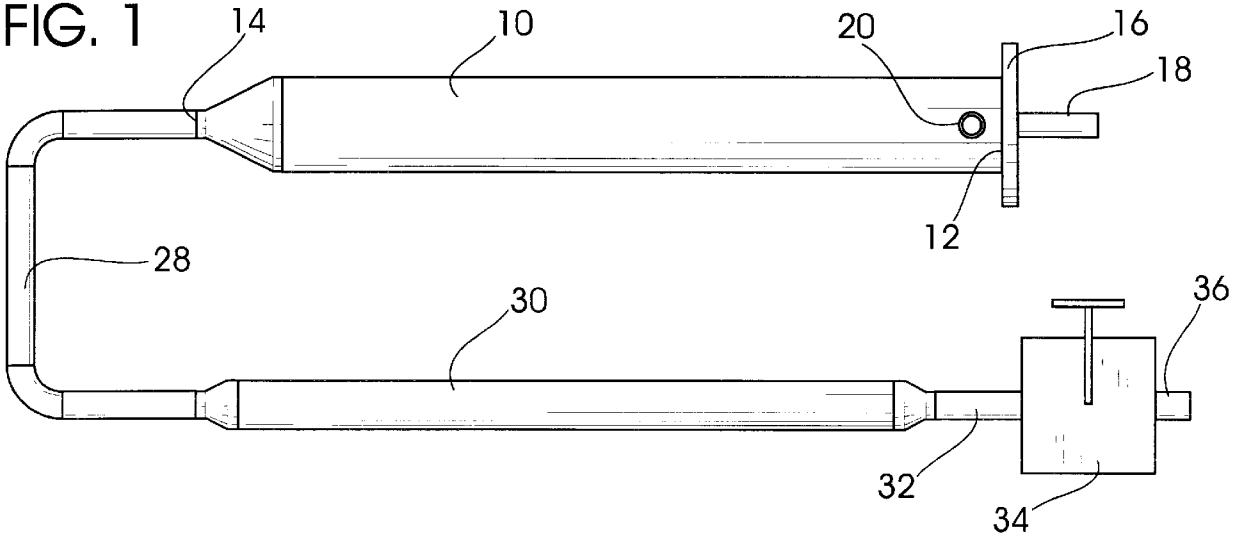
FIG. 1 is a plane view of a system for practicing the methods of this invention. The system includes a treating vessel into which crude oil and $CO_2$ or $CO_2$ plus N are injected. The system includes a stabilization vessel and a discharge conduit by which the treated reduced viscosity crude oil may be conveyed to a pipeline or to other process equipment.

Referring to the drawings, FIG. 1 shows the basic components required for practicing the invention. An elongated cylindrical horizontal treating vessel as indicated by the numeral 10. Vessel 10 has an inlet end 12 and an outlet end 14. At the inlet end 12 a flange 16 receives a gas injection pipe 18. In the cylindrical walls of vessel 10 adjacent inlet end 12 is an oil inlet 20.

Figure 2:
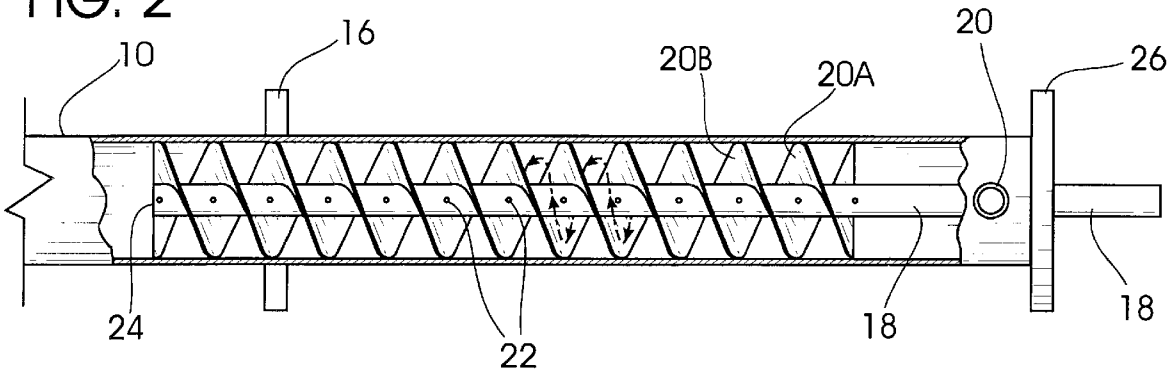
FIG. 2 is an enlarged elevational view of a gas injector pipe having a spiral fin thereon as employed within the treating vessel of FIG. 1.

FIG. 2 shows an interior component of the treatment vessel 10. Gas injection pipe 18 is centrally positioned within vessel 10 and has affixed to its exterior surface a spiraled fin. In the illustrated arrangement there are twin spiral fins 20A and 20B although a single spiral fin would achieve the same results. Gas pipe 18 has spaced apart small diameter gas outlet openings 22, the openings being intermediate spiral fins 20A and 20B. The distal end 24 of gas pipe 18 is closed although the closed end could have a small diameter gas outlet opening therein. An attachment flange 26 is secured to gas injection pipe 18 to mate with vessel flange 16 by which the injection with its spiral fin is maintained within the assembly. In the treatment process, low gravity, that is, viscid crude oil is injected through oil endlet 20 at high pressure, such as a minimum of about 600 psi. Simultaneously gas is injected under the same or a greater pressure through gas pipe 18.

Gas is ejected through spaced small diameter openings 22 and thoroughly admixed with the crude oil as it flows through the vessel. The gas is absorbed by the low gravity crude oil. Sufficient gas is employed to attain the amount of reduction of viscosity that is required by the process. That is, if the crude oil injected through oil inlet 20 is only marginally too viscid for transportation a relatively smaller amount of gas needs to be injected to raise the gravity as required however, if the crude oil is very viscid then larger amounts of gas are required. The maximum amount of gas to be used is that which will be absorbed within the crude oil. That is, the system is not predicated upon creating a dual phase mixture in which the crude oil is less viscid because of entrained bubbles of gas but the system is predicated upon mixing gas within the oil under conditions so that the gas is absorbed and the output of the mixture at vessel outlet 14 is essentially a single phase crude oil liquid with absorbed gas.

The process must be conducted at high pressures. The pressure within vessel 10 must be a minimum of at least about 600 psi and the pressure can increase up to about 1800 psi or higher. The pressure used in the method is that which is required to cause the absorption of sufficient gas to obtain the required viscosity reduction.

The crude oil that flows out outlet end 14 of vessel 10 passes into a conduit 28 and then into an entrainment vessel 30 that has an increased cross-sectional area. The velocity of flow of the treated crude oil within the larger diameter entrainment vessel 30 is reduced, serving to increase the absorption of gas by the crude oil. A conduit 32 at outlet end of entrainment vessel 30 passes the treated crude oil through a choke 34 to an outlet pipe 36 that can connect with a pipeline or other processing equipment.

Figure 3:
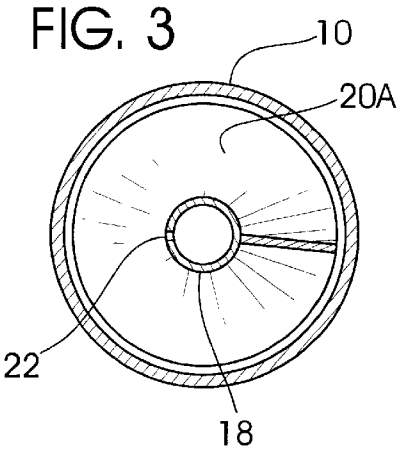
FIG. 3 is a cross-sectional view taken along the line 3—3 of FIG. 1 showing the gas injection pipe centrally positioned within the treating vessel with a spiral fin extending around the injection pipe.

The system as illustrated in FIGS. 1–3 is an example of one way of thoroughly admixing an injected gas into low gravity crude oil to reduce its viscosity. The illustrated system does not employ moving parts to achieve mixing although the use of mixers with moving parts may also be advantageous in some applications. The essence of the system as illustrated in FIGS. 1–3 is that which achieves thorough admixing of gas and oil so that all or at least substantially all of the gas is absorbed by the crude oil to provide a single phase fluid flow of reduced viscosity crude oil that can be more efficiently pumped or otherwise used in processing systems.

The expression "gas" as used herein means $CO_2$ or a mixture of $CO_2$ and N.

Successful testing of the system of FIGS. 1–3 has involved processing heavy oil that is best described as "tank bottoms", in the range of 15 to 22 gravity oil. Tests were conducted on crude oil using pressures from 600 psi to 1800 psi. Measured gravity at the discharge point of the equipment that is, in conduit 32 in the arrangement of FIG. 1, at 800 psi was 35.5; at 900 psi, 38.5; and at 1000 psi, 41+ gravity, that is higher than the available measuring device. These tests therefore indicate that the increase in gravity, that is, the reduction in viscosity, is proportional to the pressure under which the gas is admixed with the crude oil. In addition, the higher the pressure the greater the quantity of gas that can be absorbed by the crude oil.

In this test the treated crude oil, that is crude oil with absorbed $CO_2$ or $CO_2$ plus N, at an elevated pressure was then exposed to the atmosphere. When exposed to the atmosphere there was no visual indication of an immediate boiling off or flashing off of the gas from the treated crude oil however, it is understood that over time when the treated crude oil is subjected to ambient pressures that the absorbed gas will eventually be dissipated in which case the crude oil will return to its natural viscosity. An essential discovery resulting from this invention is that crude oil thoroughly admixed with $CO_2$, or $CO_2$ plus N, at elevated pressures, experiences a significant increase in gravity and the improved gravity characteristic subsists for a significant time after elevated pressures are removed to permit the treated crude oil to be more efficiently pumped through a pipeline.

The invention as described herein and particularly the apparatus shown in FIGS. 1–3 is exemplary of one system for practicing the methods of this invention. At the time of preparation of this disclosure additional research is ongoing and it is apparent that additional testing will result in a better understanding of the invention so that the ratios of gases and pressure required to achieve targeted reductions in viscosity of crude oil can be more accurately predicted. In addition, the advantageous employment of relative ratios of $CO_2$ and N will be more particularly defined by additional experimentation.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A system for reducing the viscosity of crude oil comprising:

an elongated pressurized treating vessel having a crude oil inlet and a gasified crude oil outlet;

a reduced diameter gas injection pipe coaxially positioned substantially along its entire length within said treating vessel and having a plurality of spaced apart small diameter outlet openings therein along substantially its entire length and a larger diameter gas inlet opening communicating with the exterior of said treating vessel; and an auger-shaped fin spirally supported on an exterior surface of said gas injection pipe, crude oil flowing under pressure into said treating vessel through said crude oil inlet passing in a circuitous route around said gas injection pipe as channeled by said fin past said plurality of small diameter openings along substantially the length of said gas injection pipe whereby $CO_2$ gas injected under pressure into said gas injection pipe is thoroughly mixed with said crude oil and said $CO_2$ gas substantially completely absolved within said treating vessel to form a substantially single phase gasified crude oil that is discharged through said gasified crude oil outlet.

2. A system for reducing the viscosity of crude oil according to claim 1 including;

an entrainment vessel having an inlet opening and an outlet opening, the inlet opening being connected by a conduit with said treating vessel gasified crude oil outlet, the entrainment vessel having a flow path therethrough having a cross-sectional area greater than a flow path through said conduit whereby the velocity of flow of gasified crude oil is reduced as said crude oil passes through the entrainment vessel to thereby augment absorption of gas by said gasified crude oil passing therethrough, gasified crude oil having increased gas absorbed therein passing out said entrainment vessel outlet opening.

3. A system for reducing the viscosity of crude oil according to claim 2 including;

a controllable choke having an inlet end connected to said entrainment vessel outlet opening and an outlet end, the controllable choke providing a variable area flow restriction through which gasified crude oil passes.

4. A method of decreasing the viscosity of crude oil comprising:

injecting into crude oil $CO_2$ gas at an elevated pressure of at least about 600 psi; and intimately mixing said $CO_2$ gas with said crude oil at said pressure range in an elongated horizontal cylindrical pressurized treating vessel having within it a reduced diameter coaxial gas injection pipe, the gas injection pipe having a plurality of spaced apart small diameter openings therein along substantially its entire length and having an auger-shaped fin affixed to the exterior of the gas injection pipe substantially along its entire length to cause said crude oil flowing through said treating vessel to take a circuitous route around said gas injection pipe and to cause $CO_2$ gas to be substantially fully absorbed by the crude oil to provide a substantially single phase gasified crude oil that is discharged from said treating vessel.

5. A method of decreasing the viscosity of crude oil according to claim 4 wherein $CO_2$ is mixed with N (nitrogen gas) at a ratio ranging by weight from 8% $CO_2$ to 92% N to 100% $CO_2$ to 0% N.

6. A method of decreasing the viscosity of crude oil according to claim 4 wherein the pressure at which $CO_2$ is injected into said crude oil is about 600 psi to about 1800 psi.

7. A method of decreasing the viscosity of crude oil according to claim 4 in which the quantity of $CO_2$ at the selected injection pressure is sufficiently great to reduce the crude oil viscosity to that required and that is not substantially greater then the quantity of $CO_2$ that the crude oil will absorb at said selected injection pressure.

* * * * *